US012722055B2

(12) United States Patent
Chang

(10) Patent No.: US 12,722,055 B2
(45) Date of Patent: Sep. 1, 2026

(54) ADJUSTABLE RACKET

(71) Applicant: Yu Jen Chang, Taichung (TW)

(72) Inventor: Yu Jen Chang, Taichung (TW)

( * ) Notice: Subject to any disclaimer, the term of this patent is extended or adjusted under 35 U.S.C. 154(b) by 317 days.

(21) Appl. No.: 18/436,530

(22) Filed: Feb. 8, 2024

(65) Prior Publication Data

US 2025/0256177 A1 Aug. 14, 2025

(51) Int. Cl.
*A63B 59/40* (2015.01)

(52) U.S. Cl.
CPC ..... *A63B 59/40* (2015.10)

(58) Field of Classification Search
CPC ..... A63B 59/40; A63B 59/42; A63B 2102/08; A63B 60/42463; A63B 2209/02; A63B 2209/10
See application file for complete search history.

(56) References Cited

U.S. PATENT DOCUMENTS

2022/0296973 A1* 9/2022 Bonfigli ..... A63B 60/50
2023/0097939 A1* 3/2023 Kang ..... A63B 59/40 473/527
2024/0226679 A1* 7/2024 Lin ..... A63B 59/48
2025/0041686 A1* 2/2025 Paselk ..... A63B 59/42
2025/0177829 A1* 6/2025 Paselk ..... A63B 59/42
2025/0345678 A1* 11/2025 Stroh ..... A63B 59/45
2025/0387683 A1* 12/2025 Marcos Andrada ... A63B 59/48

FOREIGN PATENT DOCUMENTS

CN 213049277 U * 4/2021
CN 218187773 U * 1/2023
FR 3064186 A1 * 9/2018 ..... A63B 59/48

* cited by examiner

*Primary Examiner* — Dmitry Suhol
(74) *Attorney, Agent, or Firm* — Birchwood IP

(57) ABSTRACT

Disclosed is a novel adjustable racket, including a main frame, a core board and cover boards, wherein the main frame includes a handle and a border, the handle and the border are integrally formed, the main frame is provided with a mounting position, the core board is detachably arranged in the mounting position, and the cover boards are detachably arranged on the main frame. In this way, the core board and the cover boards can be replaced according to the needs of users. Different combinations of the core board and the cover boards can achieve different hitting effects.

19 Claims, 7 Drawing Sheets

ADJUSTABLE RACKET

TECHNICAL FIELD

The present invention relates to the technical field of rackets, in more particular to a novel adjustable racket.

BACKGROUND

Usually, we play beach tennis on the beach, but it can also be played in any season and venue, such as sand, grass, hardwood, etc., even snow. Compared with tennis, beach tennis is very easy to learn. Beginners, stepping into the court in few minutes or even for the first time, can play it continuously for a long time. Beach tennis is both competitive and entertaining, and it's easy to learn, so athletes and non-athletes of all ages can join in this game.

Pickleball is a sport played by hitting a ball with a racket. It is a hybrid of tennis, badminton, and table tennis. Pickleball has become a regular sport in PE classes of middle schools, and has gradually become popular with young and old.

Bats and beach tennis rackets mainly include a racket part and a handle part that are separately arranged. The racket part has a hitting surface for hitting the ball. The pickleball rackets and beach tennis rackets of the prior art both have problems that their heating faces cannot be replaced.

SUMMARY

The technical problem to be solved by the present invention is to provide a novel adjustable racket with simple and replaceable components.

The objective of the present invention is reached through the following technical solution:

A novel adjustable racket includes a main frame, a core board and cover boards, wherein the main frame includes a handle and a border, the handle and the border are integrally formed, the main frame is provided with a mounting position, the core board is detachably arranged in the mounting position, and the cover boards are detachably arranged on the main frame.

Optionally, two cover boards are provided; each of the cover boards includes a face board and a binding, the binding is integrally formed along an edge of the face board, the two cover boards are mounted on the main frame from two sides of the racket, and the bindings of the two cover boards work together to cover an outer side of the border.

Optionally, the core board includes a support layer and two cork layers, the cork layers are made of cork, the two cork layers are respectively provided on upper and lower surfaces of the support layer, and the support layer is made of any one of a PP board, a PMI board, a Balsa wood board and a foam board or made of a composite board with stacks of more than one of a PP board, a PMI board, a Balsa wood board and a foam board.

Optionally, the core board is made of a foam material, a limiting groove is provided at a sweet spot zone of the core board, a cork board is fitted in the limiting groove, an upper surface of the cork board is flush with an upper surface of the foam board and in the shape of a flat surface, and the cork board is provided with through holes at even intervals.

Optionally, a filling block is fitted in each through hole, the filling block includes a main body made of an EVA material and an outer layer made of a carbon fiber yarn, and the outer layer is wrapped around an outer surface of the main body.

Optionally, an adhesive layer is provided on an inner side of each cover board, and the thickness of the adhesive layer ranges from 20 μm to 150 μm.

Optionally, an adhesive layer is provided on an inner side of each cover board, the thickness of the adhesive layer ranges from 30 μm to 200 μm, and the adhesive layer covers inner surfaces of the face board and the binding.

Optionally, the cover boards include a rough cover board, the rough cover board includes a rough layer and a base layer, the base layer is made of a carbon fiber yarn or a glass fiber yarn, and the rough cover board is made by shaping and solidifying in a mold the rough layer that is attached to an outer surface of the base layer impregnated with resin.

Optionally, the cover boards include a smooth cover board, and the smooth cover board is made by shaping and solidifying in a mold a carbon fiber yarn or a glass fiber yarn impregnated with resin.

Optionally, the core board is in an interference fit with the mounting position and the thickness of the core board is less than the thickness of the main frame.

Optionally, the core board is in an interference fit with the mounting position and the thickness of the core board is equal to the thickness of the main frame.

Optionally, the main frame is integrally formed of a carbon fiber or a glass fiber yarn.

In the present invention, the core board and the cover boards can be detachably mounted on the main frame, so that the core board and the cover boards can be replaced according to the needs of users. Different combinations of the core board and the cover boards endow the strength, elasticity, hardness, friction or sound and other structural characteristics on a hitting surface of the racket, thereby achieving different hitting effects, such as the differences in hitting feel or hitting sound caused by the racket. Moreover, the handle and the boarder are formed integrally to form the main frame, which can further reduce components of the racket that need to be assembled. In this way, the assembly of the racket and the replacement of the core board and cover boards become easier.

Figure 1:
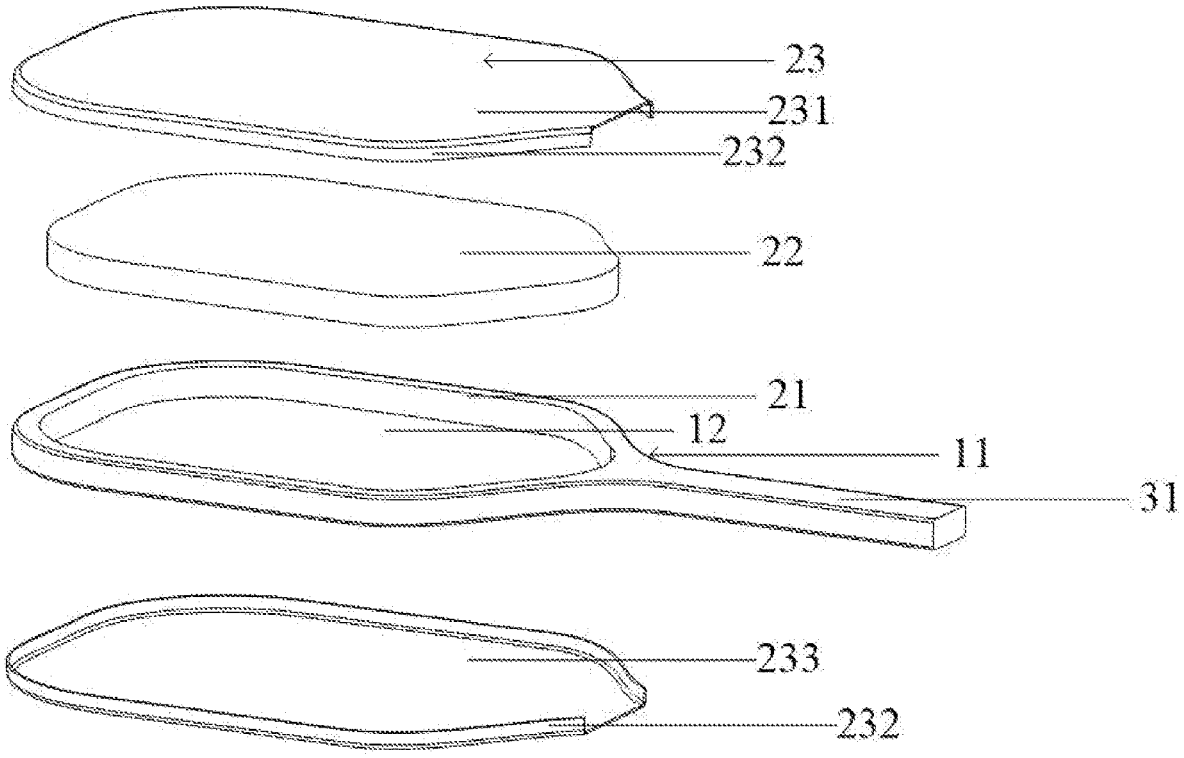
FIG. 1 is a schematic exploded diagram of a racket according to an embodiment of the present invention.
Figure 2:
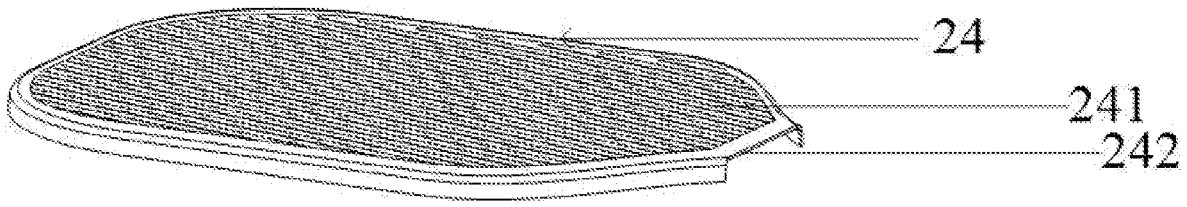
FIG. 2 is a schematic structural diagram of a rough cover board according to an embodiment of the present invention.
Figure 3:
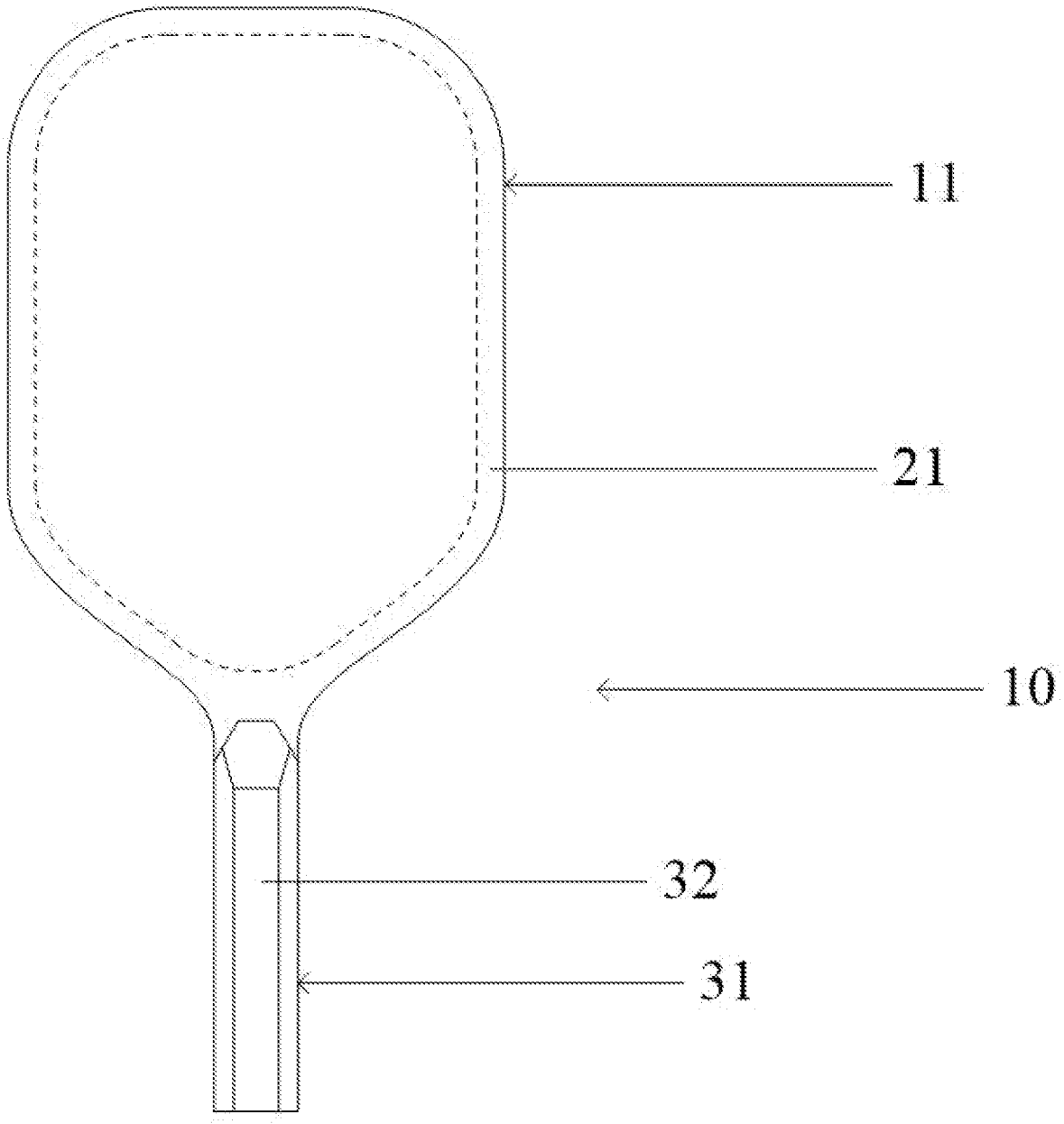
FIG. 3 is a schematic structural diagram of the racket according to an embodiment of the present invention.

In the figures, 10. racket; 11. main frame; 12. mounting position; 21. board; 22. core board; 23. Cover board; 231. face board; 232. binding; 233. adhesive layer; 24. rough cover board; 241. rough layer; 242. base layer; 25. support layer, 251. Balsa wood, 252. PP board, 26. cork layer, 261. cork board, 262. through hole, 271. sweet spot zone, 272. limiting groove, 28. filling block, 281. main body, 282. outer layer, 31. handle; 32. decorative board.

DESCRIPTION OF EMBODIMENTS

In the description of the invention, it should be understood that the orientations or positional relationships, indicated by the terms "center", "lateral", "upper", "lower", "left", "right", "vertical", "horizontal", "top", "bottom", "inside", "outside" and the like, are based on the orientations or positional relationships shown in the drawings and are only for the purpose of facilitating and simplifying the description of the invention, rather than indicating or implying that the described device or element must have a particular orientation or must be constructed and operated in a particular orientation, and therefore they cannot to be construed as limiting the invention. In addition, terms "first" and "second" are used merely for the purpose of description, and shall not be construed as indicating or implying relative importance or implying a quantity of indicated technical features. Therefore, a feature limited by "first" or "second" may explicitly or implicitly include one or more of the features.

In the description of the invention, the meaning of "a plurality of" is two or more, unless otherwise specified. In addition, the term "include" and any variations thereof are intended to cover non-exclusive inclusion.

In the description of the invention, it should be noted that, unless otherwise clearly specified and limited, the terms "install", "link", and "connect" should be understood in a broad sense; for example, a connection may be a fixed connection, a detachable connection, or an integrated connection; it may be a mechanical connection, an electrical connection, or a communication connection; and it may be a direct connection, an indirect connection through an intermediate medium, or a connection inside two components. For those skilled in the art, the specific meanings of the above terms in this disclosure could be understood according to the specific conditions.

The invention will be further described below with reference to the drawings and preferred embodiments.

As shown in FIGS. 1-7, this embodiment discloses a novel adjustable racket 10, including a main frame 11, a core board 22 and cover boards 23, wherein the main frame 11 includes a handle 31 and a border 21, the handle 31 and the border 21 are integrally formed, the main frame 11 is provided with a mounting position 12, the core board 22 is detachably arranged in the mounting position 12, and the cover boards 23 are detachably arranged on the main frame 11.

The core board 22 and the cover boards 23 can be detachably mounted on the main frame 11, so that the core board 22 and the cover boards 23 can be replaced according to the needs of users. Different combinations of the core board 22 and the cover boards 23 endow the strength, elasticity, hardness, friction or sound and other structural characteristics on a hitting surface of the racket 10, thereby achieving different hitting effects, such as the differences in hitting feel or hitting sound caused by the racket 10. Moreover, the handle 31 and the boarder 21 are formed integrally to form the main frame 11, which can further reduce components of the racket 10 that need to be assembled. In this way, the assembly of the racket 10 and the replacement of the core board 22 and cover boards 23 become easier. Of course, the main frame 11 can also be replaced according to the needs of users. The racket 10 is generally used as a pickleball racket, a beach tennis racket, etc.

Two cover boards 23 are provided. Each of the cover boards 23 includes a face board 231 and a binding 232, the binding 232 is integrally formed along an edge of the face board 231, and a chamfer is formed between the face board 231 and the binding 232 to better fit the main frame 11 and meet better use requirements. The two cover boards 23 are mounted on the main frame 11 from two sides of the racket 10, and the bindings 232 of the two cover boards 23 work together to cover an outer side of the border 21. By mounting the two cover boards 23 on the main frame 11 from the two sides of the racket 10, the entire main frame 11 and the core board 22 can be effectively sealed and covered, thereby further ensuring the installation stability of the core board 22.

The core board 22 includes a support layer 25 and two cork layers 26. The cork layers 26 are made of cork. The two cork layers 26 are respectively provided on upper and lower surfaces of the support layer 25. The cork, also known as phellem, is the outer bark product of a Mediterranean oak tree. It is the surface protective tissue of the thickened stems and roots. Through the arrangement of the cork layers 26, the weight of the racket 10 can be effectively reduced, so that the racket 10 is more comfortable to use and achieves relatively good elasticity and compression. The cork layers can be quickly compressed and rebound when hitting a ball, thereby ensuring a good hitting feel. The cork layers 26 is fitted on the support layer 25, which can ensure good support performance of the inner board and also achieve better sound insulation performance, thereby effectively reducing impact noise. The cork layers 26 made of cork are relatively environmentally friendly and have relatively good wear resistance. The cork layers can maintain high resilience even if they are compressed. In addition, the face board 231 can not only effectively protect the inner board, but also increase the friction between the face of the racket and a pickleball when the racket hits the ball, increase the rotation speed of the pickleball, and further optimize the hitting feel.

Figure 4:
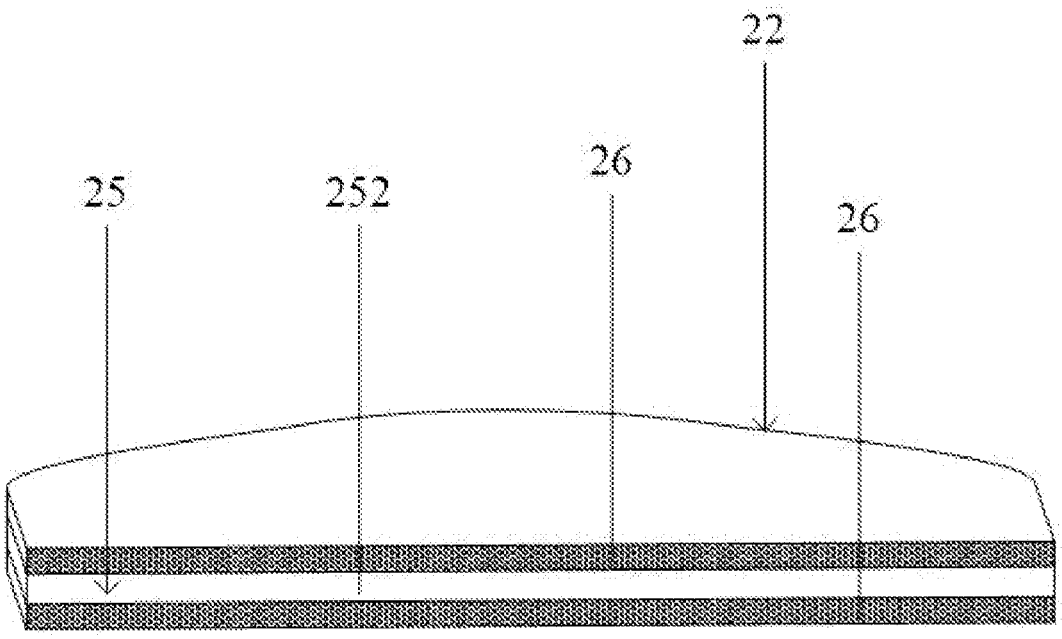
FIG. 4 is a schematic cross-sectional diagram of a core board according to an embodiment of the present invention.
Figure 5:
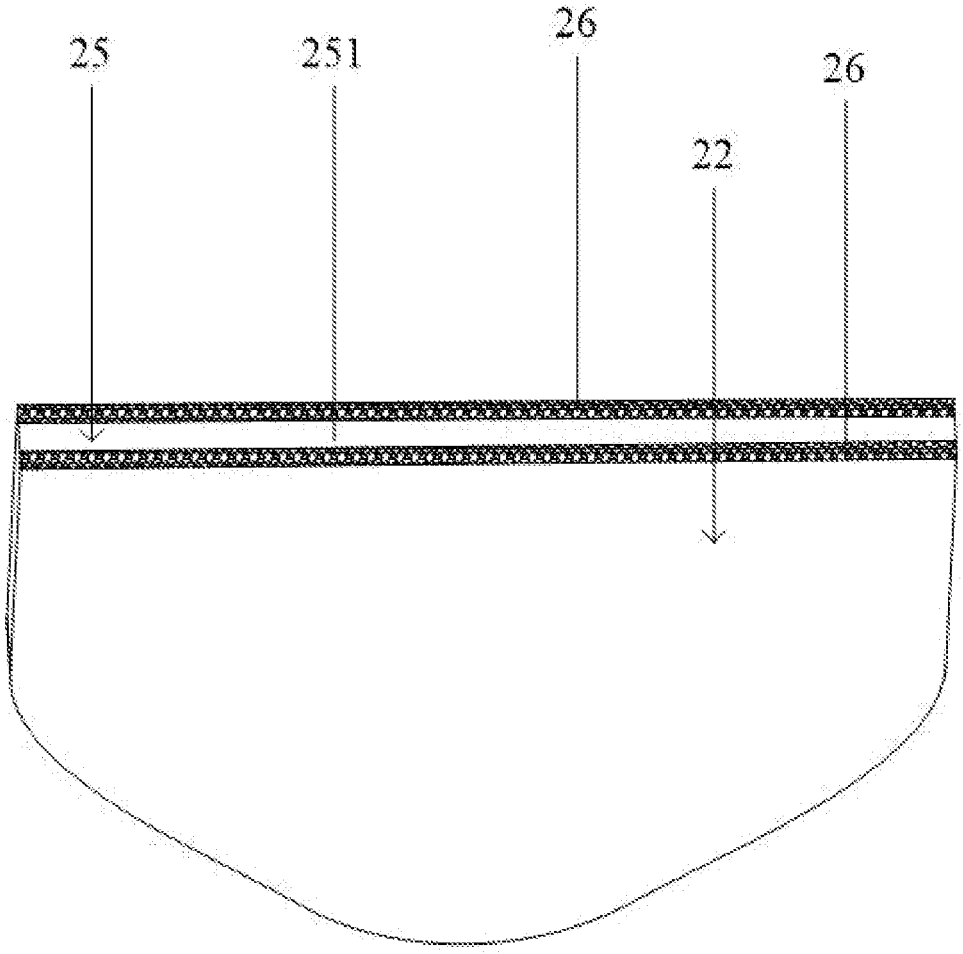
FIG. 5 is a schematic sectional diagram of the core board according to an embodiment of the present invention.

The support layer 25 is made of any one of a PP board 252, a PMI board, a Balsa wood board and a foam board or made of a composite board with stacks of more than one of a PP board, a PMI board, a Balsa wood board and a foam board. As shown in FIG. 5, the support layer 25 is cut and shaped from a piece of solid board of Balsa wood 251. Compared with a traditional single-layer metal board or plastic honeycomb board, the Balsa wood 251 not only makes the racket lighter, thereby improving the comfort of hitting the ball. The combination of the support layer 25 made of the Balsa wood 251 and the cork layers 26 can very effectively absorb vibration caused by ball hitting and further effectively reduce the frequency and volume of sound made by ball hitting, thereby achieving a good noise reduction effect. Compared with traditional plastic honeycomb boards, the Balsa wood board is more environmentally friendly and durable, and can provide a good support effect for the cork layers 26, thereby further improving the overall structural strength of the racket 10. As shown in FIG. 4, the support layer 25 is made of a PP (polypropylene) material or a PMI (polyimide foam). The PP board 252 made of the PP material has relatively good tensile strength, compressive strength and hardness, outstanding rigidity and bending fatigue resistance. The support layer 25 is cut and formed of a whole piece of PP board 252, and can provide a good support effect for the cork layers 26, thereby further improving the overall structural strength of the racket 10.

Figure 6:
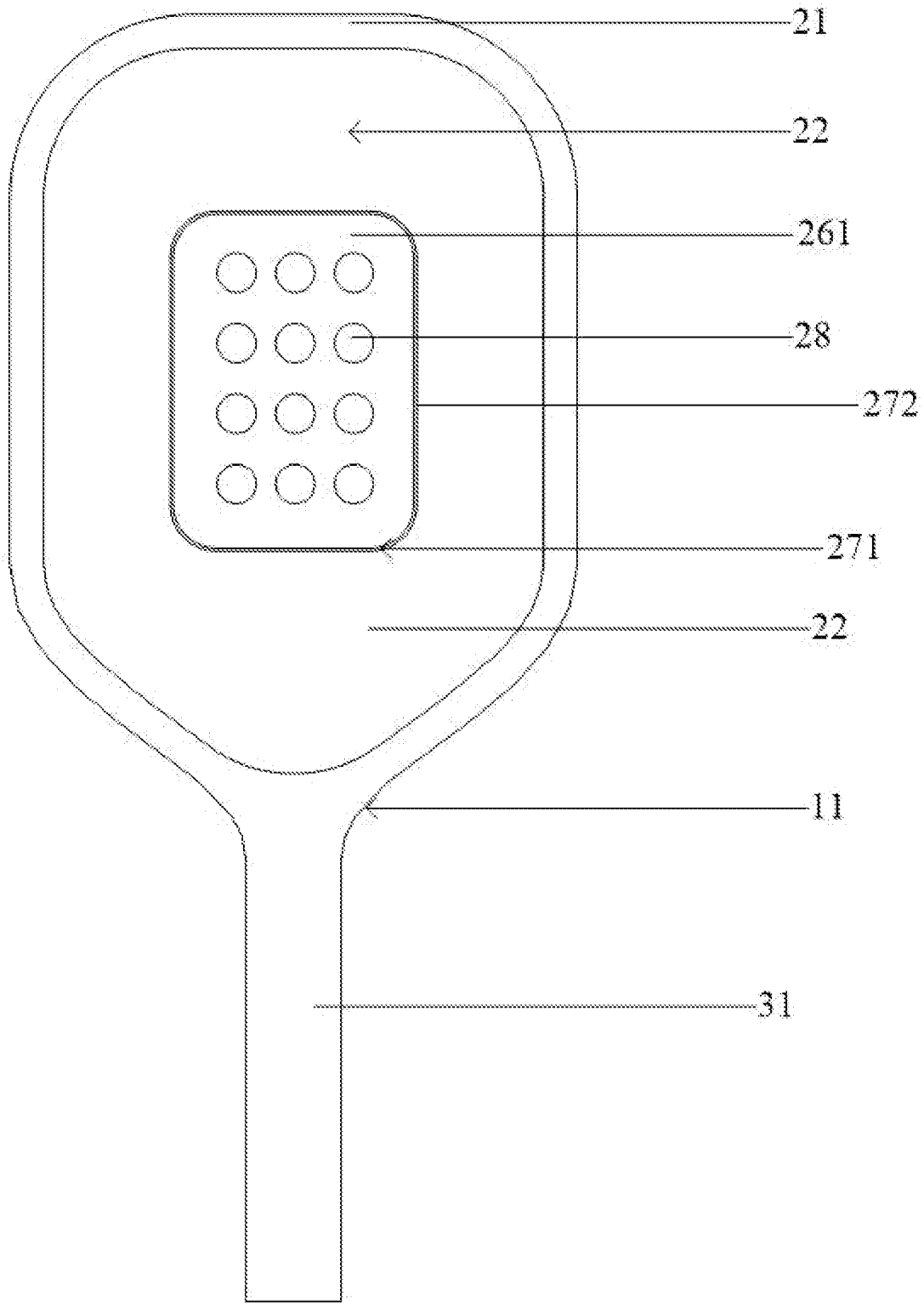
FIG. 6 is a schematic sectional diagram of the core board according to an embodiment of the present invention mounted on a main frame.

As shown in FIG. 6, the core board 22 is made of a foam material, such as an EVA material. A limiting groove 272 is provided at a sweet spot zone 271 of the core board 22, a cork board 261 is fitted in the limiting groove 272, an upper surface of the cork board 261 is flush with an upper surface of the core board 22 and in the shape of a flat surface, and the cork board 261 is provided with through holes 262 at even intervals. A structure with through holes but no filling blocks 28 is used to make beach tennis rackets. By forming holes at the corresponding position on the cover boards, the weight of the rocket can be effectively reduced. Filling blocks 28 are provided in the through holes 262. By providing the filling blocks 28 in the through holes 262 on the cork board 261, it can ensure good support performance of the inner board and also achieve good sound insulation performance, thereby effectively reducing impact noise. Moreover, the cork board 261 can effectively reduce the weight of the racket 10, making the use of the racket 10 more comfortable. In addition, the filling blocks 28 can be made on the basis of characteristics of different materials, thereby achieving good elasticity and compression. The filling blocks can be quickly compressed and rebound when hitting a ball, thereby ensuring a hitting feel. Moreover, the face boards 231 can not only effectively protect the inner board, but also increase the friction between the face of the racket and a pickleball or a beach tennis ball when the racket hits the ball, increase the rotation speed of the pickleball and the beach tennis ball, and further optimize the hitting feel.

Figure 7:
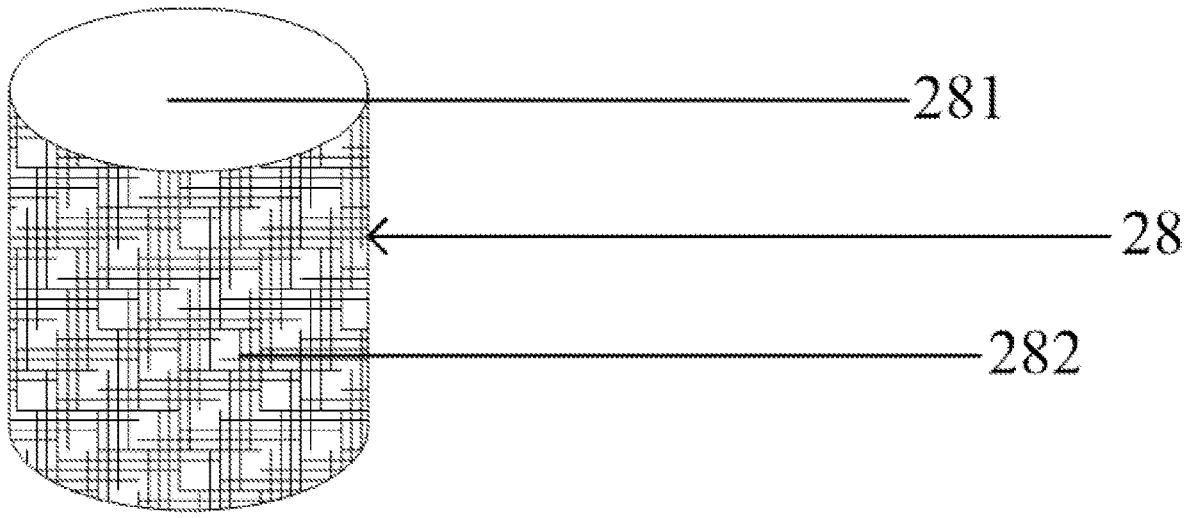
FIG. 7 is a schematic structural diagram of a filling block according to an embodiment of the present invention.

As shown in FIG. 7, the filling block 28 includes a main body 281 made of an EVA material and an outer layer 282 made of a carbon fiber yarn, and the outer layer 282 is wrapped around an outer surface of the main body 281. Using the design of the filling blocks 28 combined with the cork board 261, the face board 231 less deform when hitting a ball, which complies with the relevant specifications of the Association of Rackets 10. Moreover, the filling blocks 28 are made on the basis of characteristics of different materials and the main body 281 made of an EVA material can further reduce the weight of the inner board. The outer layer 282 made of a carbon fiber yarn can improve the strength of the inner board, further making the racket 10 more comfortable to use and ensuring a good hitting feel. Each through hole 262 is a cylindrical hole, and the main body 281 is cylindrical. By impregnating the outer layer 282 in glue, the outer layer 282 is attached to the main body 281, so that the outer layer 282 impregnated with glue can be more firmly attached to the filling block 28. The cylindrical filling block 28 facilitates the installation and setting of the outer layer 282 and also can be better fitted in the cylindrical through hole 262. The carbon fiber yarn can further increase the strength of the filling block 28 so that the racket 10 can withstand a greater impact force when hitting the ball.

An adhesive layer 233 is provided on an inner side of each cover board 23, and the thickness of the adhesive layer 233 ranges from 20 μm to 150 μm. The adhesive layer 233 is directly fixed and pasted on the inner surface of the cover board 23. The adhesive layer 233 may also be directly formed on the inner surface of the cover board 23. The thickness of the adhesive layer 233 may be selected according to the thickness of the relevant core board 22. By providing on the inner surface of the cover board 23 the adhesive layer 233 which optionally is a removable double-sided tape, users can easily replace more appropriate cover boards 23 according to their own needs to better meet the needs of use.

The cover boards 23 include a rough cover board 24, and the rough cover board 24 includes a rough layer 241 and a base layer 242. The base layer 242 is made of a carbon fiber yarn or a glass fiber yarn. The rough cover board 24 is made by shaping and solidifying in a mold the rough layer 241 that is attached to an outer surface of the base layer 242 impregnated with resin. The rough layer 241 and the base layer 242 are directly formed into one piece to ensure the integrity of the cover board 23 and the better strength of the cover board 23. The rough layer 241 on the cover board 23 can effectively increase the rotation speed of a chipped ball and achieve a better chipping effect.

Optionally, the cover boards 23 include a smooth cover board. The smooth cover board is made by shaping and solidifying in a mold a carbon fiber yarn or a glass fiber yarn impregnated with resin, thereby ensuring the integrity of the cover board and the better strength and durability of the cover board. Moreover, The cover board with a smooth outer surface makes the racket 10 simpler and more beautiful. In actual applications, users can set the two cover boards to be the same rough cover boards 24 or smooth cover boards according to their own habits and preferences, or they can set one side to be a rough cover board 24 and the other side to be a smooth cover board.

The main frame 11 is made of a carbon fiber or a glass fiber yarn. The main frame 11 made of a carbon fiber is relatively lightweight and has good rigidity. The main frame 11 made of a glass fiber yarn has better elasticity and toughness, can achieve different hitting effects, and can further strengthen the overall structural strength of the racket 10, so that the racket 10 can withstand a certain degree of impact and avoid being damaged by hitting, and the inner board can be better protected. The handle 31 and the border 21 are integrally formed to reduce the manufacturing steps of the racket 10 and improve the production efficiency. The handle 31 also includes a decorative board 32 provided on the handle 31, and the decorative border 32 is attached to the handle 31.

The core board 22 is made of any one of a PP board 252, an EVA board, and a PVC board or made of a composite board with stacks of more than one of a PP board 252, an EVA board, and a PVC board. The EVA board has better elasticity and can effectively reduce noise. The PP board 252 has good strength and strong hitting ability. Users can make a choice according to their needs. A composite board may also be formed on the basis of the characteristics of the EVA board, the PP board, and the PVC board to better meet the needs of use.

The core board 22 is in an interference fit with the mounting position 12, and the thickness of the core board 22 is less than or equal to the thickness of the main frame 11. By arranging the core board 22 with certain elasticity in the mounting position 12 by interference fit, it can ensure that the core board 22 is better caught in the mounting position 12, thereby ensuring a good fixing effect without using glue. In addition, the core board 22 can be disassembled and replaced more conveniently and simply. The thickness of the core board 22 can be set according to actual needs. The cover boards 23 work together to cover the core board 22 so that the racket 10 can have a flatter surface.

The foregoing is a further detailed description of the invention in connection with the specific preferred embodiments, and it is not to be determined that the specific embodiments of the present invention are limited to these descriptions. Multiple simple deductions or replacements made by those skilled in the field to which the present invention belongs, without departing from the spirit and scope of the invention, shall be considered as falling within the scope of the present invention.

What is claimed is:

1. An adjustable racket, comprising a main frame, a core board and cover boards, the main frame comprising a handle and a border, the handle and the border being integrally formed, the main frame being provided with a mounting position, the core board being detachably arranged in the mounting position, the cover boards being detachably arranged on the main frame;

wherein the core board is made of a foam material, a limiting groove is provided at a sweet spot zone of the core board, a cork board is fitted in the limiting groove, an upper surface of the cork board is flush with an upper surface of the foam board and in the shape of a flat surface, and the cork board is provided with through holes at even intervals.

2. The adjustable racket according to claim 1, wherein two cover boards are provided; each of the cover boards comprises a face board and a binding, the binding is integrally formed along an edge of the face board, the two cover boards are mounted on the main frame from two sides of the racket, and the bindings of the two cover boards work together to cover an outer side of the border.

3. The adjustable racket according to claim 1, wherein the core board comprises a support layer and two cork layers, the cork layers are made of cork, the two cork layers are respectively provided on upper and lower surfaces of the support layer, and the support layer is made of any one of a PP board, a PMI board, a Balsa wood board and a foam board or made of a composite board with stacks of more than one of a PP board, a PMI board, a Balsa wood board and a foam board.

4. The adjustable racket according to claim 2, wherein the core board comprises a support layer and two cork layers, the cork layers are made of cork, the two cork layers are respectively provided on upper and lower surfaces of the support layer, and the support layer is made of any one of a PP board, a PMI board, a Balsa wood board and a foam board or made of a composite board with stacks of more than one of a PP board, a PMI board, a Balsa wood board and a foam board.

5. The adjustable racket according to claim 1, wherein a filling block is fitted in each through hole, the filling block comprises a main body made of an EVA material and an outer layer made of a carbon fiber yarn, and the outer layer is wrapped around an outer surface of the main body.

6. The adjustable racket according to claim 2, wherein the core board is made of a foam material, a limiting groove is provided at a sweet spot zone of the core board, a cork board is fitted in the limiting groove, an upper surface of the cork board is flush with an upper surface of the foam board and in the shape of a flat surface, and the cork board is provided with through holes at even intervals.

7. The adjustable racket according to claim 1, wherein an adhesive layer is provided on an inner side of each cover board, and the thickness of the adhesive layer ranges from 20 μm to 150 μm.

8. The adjustable racket according to claim 2, wherein an adhesive layer is provided on an inner side of each cover board, the thickness of the adhesive layer ranges from 30 μm to 200 μm, and the adhesive layer covers inner surfaces of the face board and the binding.

9. The adjustable racket according to claim 1, wherein the cover boards comprise a first cover board, the first cover board comprises a first layer and a second layer, the second layer is made of a carbon fiber yarn or a glass fiber yarn, and the first cover board is made by shaping and solidifying in a mold the first layer that is attached to an outer surface of the second layer impregnated with resin.

10. The adjustable racket according to claim 4, wherein the cover boards comprise a first cover board, the first cover board comprises a first layer and a second layer, the second layer is made of a carbon fiber yarn or a glass fiber yarn, and the first cover board is made by shaping and solidifying in a mold the first layer that is attached to an outer surface of the second-base layer impregnated with resin.

11. The adjustable racket according to claim 1, wherein the cover boards comprise a first cover board, the first cover board comprises a first layer and a second layer, the second layer is made of a carbon fiber yarn or a glass fiber yarn, and the first cover board is made by shaping and solidifying in a mold the first layer that is attached to an outer surface of the second layer impregnated with resin.

12. The adjustable racket according to claim 5, wherein the cover boards comprise a first cover board, the first cover board comprises a first layer and a second layer, the second layer is made of a carbon fiber yarn or a glass fiber yarn, and the first cover board is made by shaping and solidifying in a mold the first layer that is attached to an outer surface of the second layer impregnated with resin.

13. The adjustable racket according to claim 1, wherein the cover boards comprise a second cover board, and the second cover board is made by shaping and solidifying in a mold a carbon fiber yarn or a glass fiber yarn impregnated with resin.

14. The adjustable racket according to claim 3, wherein the cover boards comprise a second cover board, and the second cover board is made by shaping and solidifying in a mold a carbon fiber yarn or a glass fiber yarn impregnated with resin.

15. The adjustable racket according to claim 1, wherein the cover boards comprise a second cover board, and the second cover board is made by shaping and solidifying in a mold a carbon fiber yarn or a glass fiber yarn impregnated with resin.

16. The adjustable racket according to claim 1, wherein the core board is in an interference fit with the mounting position and the thickness of the core board is less than the thickness of the main frame.

17. The adjustable racket according to claim 1, wherein the core board is in an interference fit with the mounting position and the thickness of the core board is equal to the thickness of the main frame.

18. The adjustable racket according to claim 10, wherein the core board is in an interference fit with the mounting position and the thickness of the core board is less than or equal to the thickness of the main frame.

19. The adjustable racket according to claim 1, wherein the main frame is integrally formed of a carbon fiber or a glass fiber yarn.

* * * * *